US011933492B2

(12) United States Patent
Elisei

(10) Patent No.: US 11,933,492 B2
(45) Date of Patent: Mar. 19, 2024

(54) BURNER WITH LOW-TEMPERATURE CAP

(71) Applicant: SOMIPRESS—SOCIETA' METALLI INIETTATI S.R.L., Castelfidardo (IT)

(72) Inventor: Armando Elisei, Castelfidardo (IT)

( * ) Notice: Subject to any disclaimer, the term of this patent is extended or adjusted under 35 U.S.C. 154(b) by 313 days.

(21) Appl. No.: 17/434,941

(22) PCT Filed: Mar. 5, 2020

(86) PCT No.: PCT/EP2020/055933

§ 371 (c)(1),
(2) Date: Aug. 30, 2021

(87) PCT Pub. No.: WO2020/182631

PCT Pub. Date: Sep. 17, 2020

(65) Prior Publication Data

US 2022/0170630 A1 Jun. 2, 2022

(30) Foreign Application Priority Data

Mar. 8, 2019 (IT) ..... 102019000003371

(51) Int. Cl.
*F23D 14/04* (2006.01)
*F23D 14/58* (2006.01)
*F23D 14/72* (2006.01)

(52) U.S. Cl.
CPC ..... *F23D 14/04* (2013.01); *F23D 14/58* (2013.01); *F23D 14/72* (2013.01); *F23D 2900/14062* (2013.01)

(58) Field of Classification Search
CPC ..... F23D 14/72; F23D 14/58; F23D 14/04
USPC ..... 126/39 E, 39 R; 431/354
See application file for complete search history.

(56) References Cited

U.S. PATENT DOCUMENTS 3,301,311 A 1/1967 Stohrer et al.
2018/0209657 A1* 7/2018 Simms ..... F24C 15/107

FOREIGN PATENT DOCUMENTS

EP 3094925 A1 11/2016
IT VE20120015 A1 10/2013

OTHER PUBLICATIONS

International Search Report for corresponding PCT/EP2020/055933, dated Jul. 6, 2020.
Written Opinion of the International Searching Authority for corresponding PCT/EP2020/055933, dated Jul. 6, 2020.

* cited by examiner

*Primary Examiner* — Vivek K Shirsat
(74) *Attorney, Agent, or Firm* — Egbert, McDaniel & Swartz, PLLC

(57) ABSTRACT

A burner has a body suitable for containing at least one injector, a crown disposed on the body, and a cap disposed on the crown. The geometrical structure of the crown and of the cap is such to stabilize the flames with a minimum contact between the flames and the cap, in such a way to minimize the temperature of the cap when the burner is used.

14 Claims, 17 Drawing Sheets

BURNER WITH LOW-TEMPERATURE CAP

The present invention relates to a gas burner for cooking appliances capable of guaranteeing a low temperature of the cap.

With reference to FIG. 1, a burner according to the prior art comprises three principal parts:

a body (1) suitable for containing at least one injector (2), a crown (3) disposed on the body (1), and a cap (4) disposed on the crown (3).

The crown (3) has a plurality of apertures (30) suitable for being disposed under the cap (4) for the emission of flames. FIG. 1A shows a flame (F1) at maximum power and FIG. 1B shows a flame (F2) at minimum power.

The body (1) and the crown (3) are usually made of die-cast aluminum. On the contrary, the cap (4) is made of steel or brass because it is exposed to a high temperature in the area where the flames are emitted.

The caps of the prior art are provided with a lateral edge (240) that is curved downwards and ends with an annular rib (241) that protrudes in lower position relative to a bottom surface (46) of the cap. The function of the annular rib (241) is to stabilize the flame during combustion because the annular rib (241) is disposed in front of the output of the apertures (30) of the crown.

The flames that are emitted from the apertures (30) of the crown embrace the lateral edge (240) of the cap, continuously touching the annular rib (241) of the cap (4) and bringing the cap to a temperature value higher than 600° C., especially in the area of the annular rib (241). Therefore, metal materials, such as brass or steel, have been so far used for the cap in order to prevent the cap from being deformed during use. As a matter of fact, different materials, such as aluminum, would not withstand a temperature value higher than 600° C.

EP3094925 discloses a gas burner with a sheet metal cover provided with a constant thickness of approximately 1-2 mm. Because of the low thickness of the cover, the flame that is emitted from the apertures of the cap is not directed correctly; moreover, a backfire with liquid gases would be originated. In order to solve such a problem, the crown or divider of the burner is provided with radial slots that are directed towards the apertures of the cap in order to define the inclination of the flames that are emitted from the apertures of the cap and prevent the backfire. The air-gas mixture in the distribution channel under the cover flows outwards in radial direction, passes through the radial slots of the divider and reaches the apertures of the cap. Such a solution is impaired by the fact that a poor supply of air-gas mixture is supplied to the pilot flames that are disposed in peripheral position relative to the primary flames that are emitted from the apertures of the cover. In fact, the majority of the air-gas mixture is supplied in the apertures of the cap and only a small part of the air-gas mixture follows a "U"-shaped route to supply the pilot flames.

The purpose of the present invention is to eliminate the drawbacks of the prior art by disclosing a burner provided with a structure that is suitable for minimizing the temperature of the cap.

Another purpose of the present invention is to disclose a burner that is efficient, reliable, inexpensive and simple to make.

An additional purpose of the present invention is to disclose a burner that is capable of using a cap made of a material other than brass or steel.

These purposes are achieved according to the invention with the characteristics of the independent claims 1 and 8.

Advantageous embodiments of the invention appear from the dependent claims.

The applicant has devised a burner with a structure that is suitable for reducing the temperature value of the cap under 600° C. In order to reduce the temperature in the area where the flames are emitted, the crown and the cap must have a geometry that is suitable for reducing the thermal gradient and at the same time is capable of stabilizing the flame.

The cap according to the invention is defined in the independent claims 1 and 9.

The fact that the cap can be made of materials that withstand temperature values lower than 600° C. means that several types of materials, such as aluminum, can be used with different production processes, for example die-casting. In view of the above, caps with a new design and a lower cost compared to the prior art can be obtained.

Additional features of the invention will appear clear from the following detailed description, which refers to merely illustrative, not limiting embodiments, as shown in the appended figures, wherein.

Figure 1:
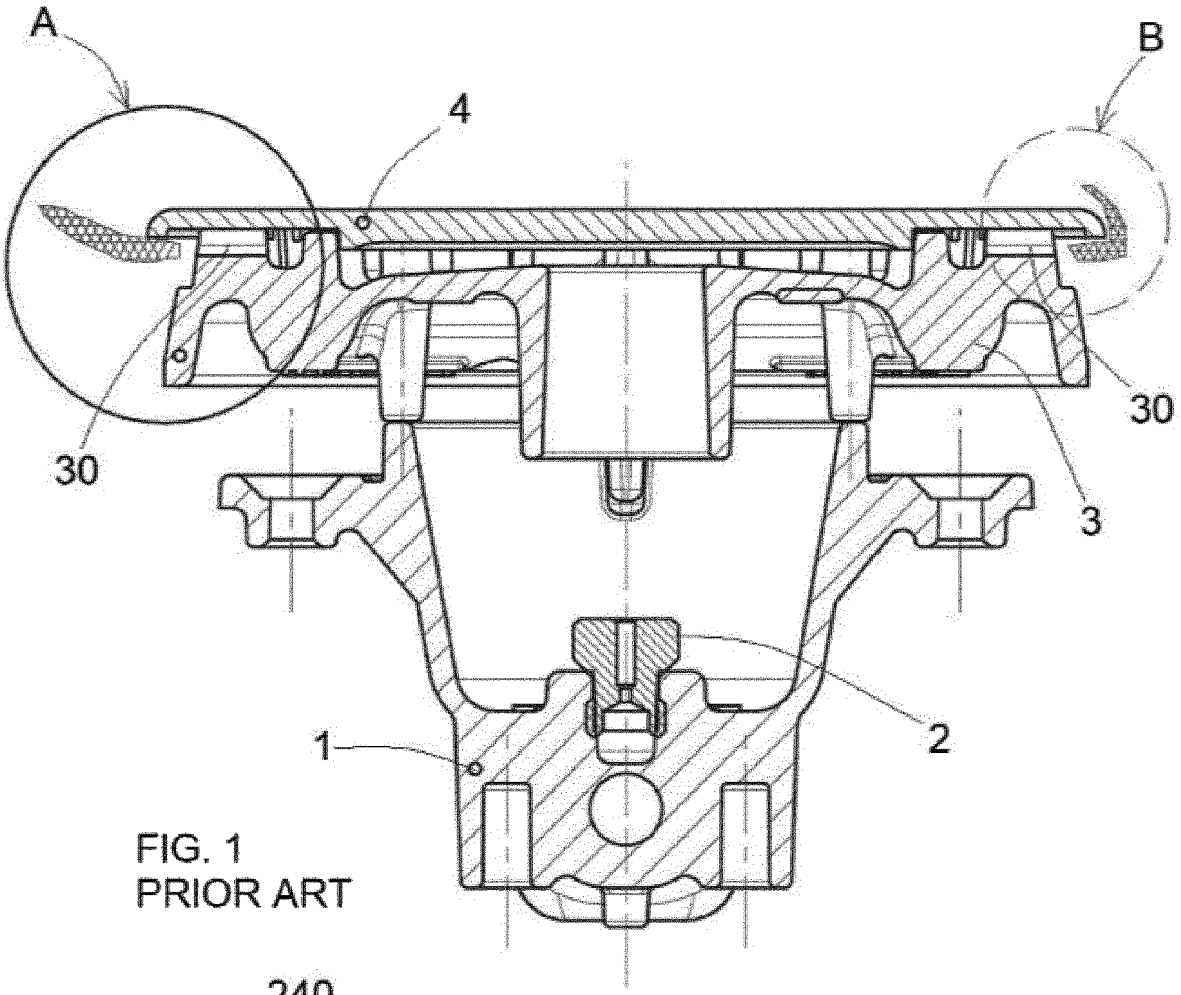
FIG. 1 PRIOR ART
FIG. 1 is an axial view of a burner according to the prior art, which shows a flame at maximum power and a flame at minimum power in the circles A and B, respectively.
Figure 1A:
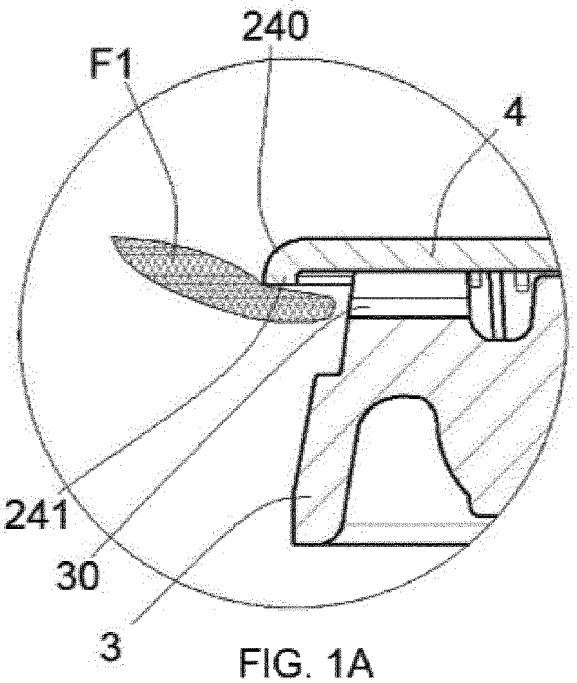
FIGS. 1A and 1B are two enlarged views of the details enclosed in the circles A and B of the burner of FIG. 1.
Figure 1B:
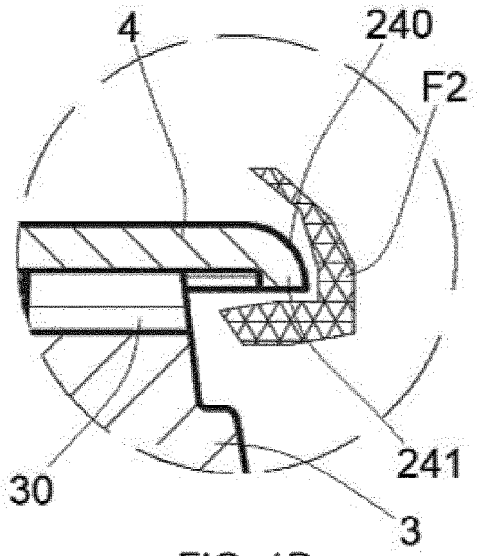
Figure 2:
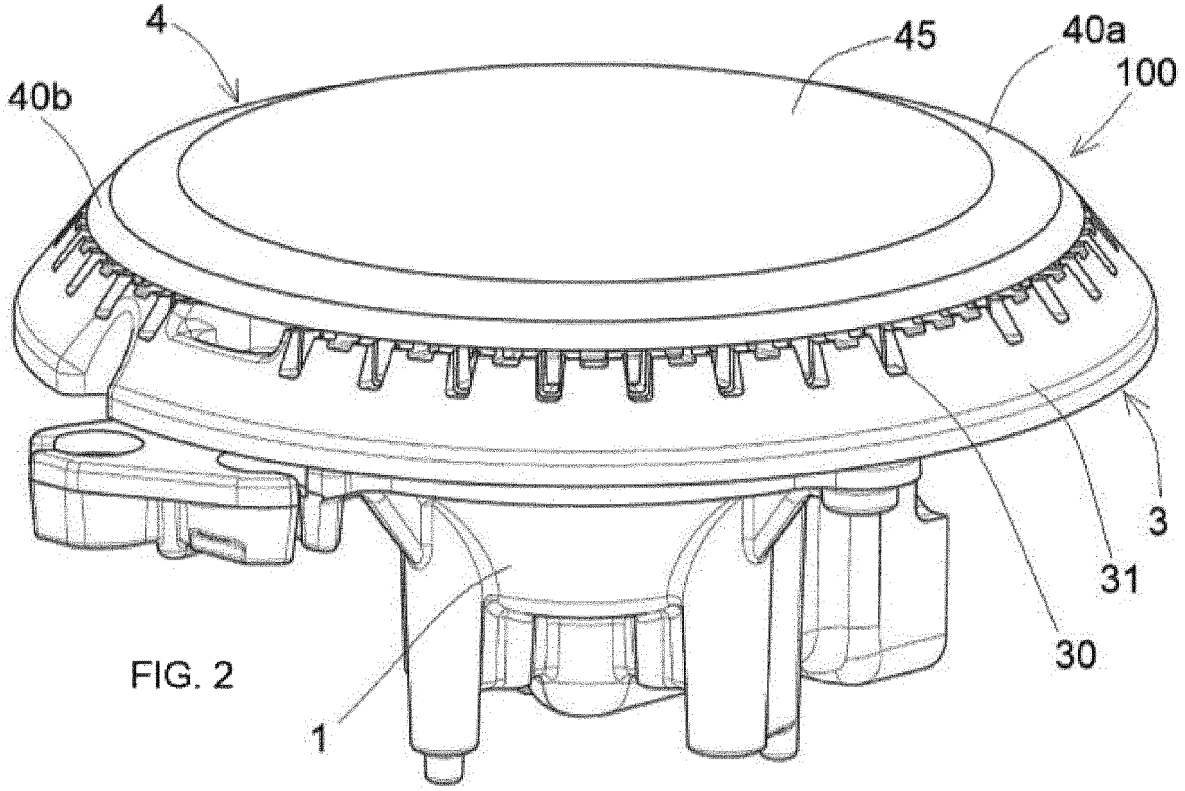
FIG. 2 is a perspective view of a first embodiment of a burner according to the invention.
Figure 2A:
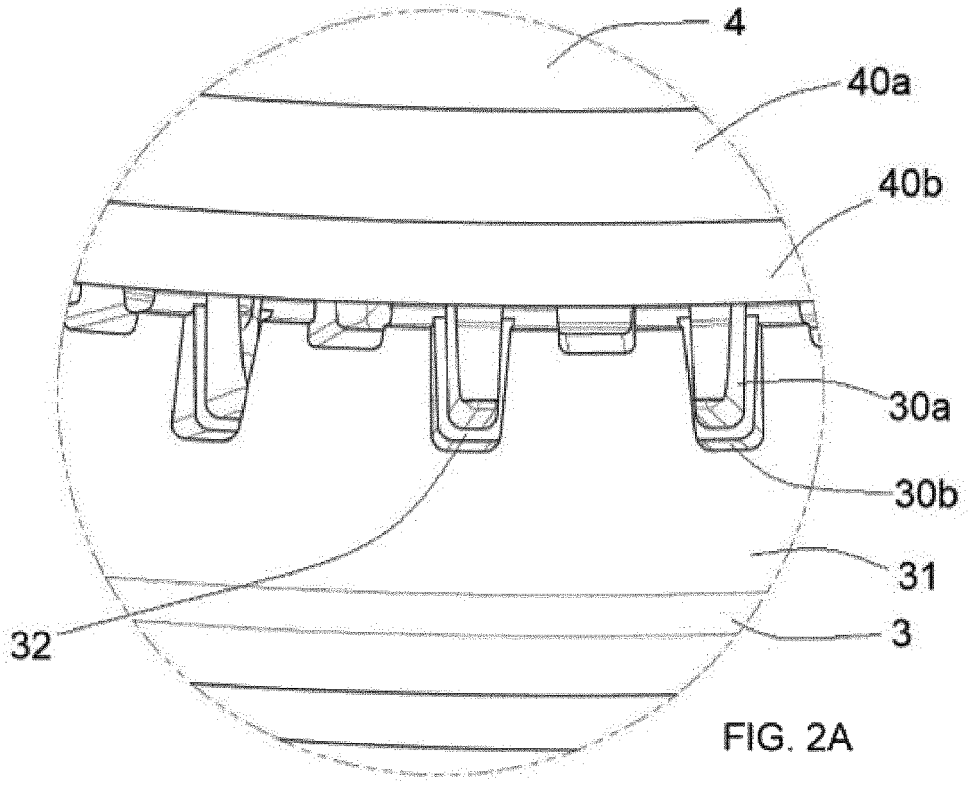
FIG. 2A is an enlarged view of a detail of FIG. 2.
Figure 3:
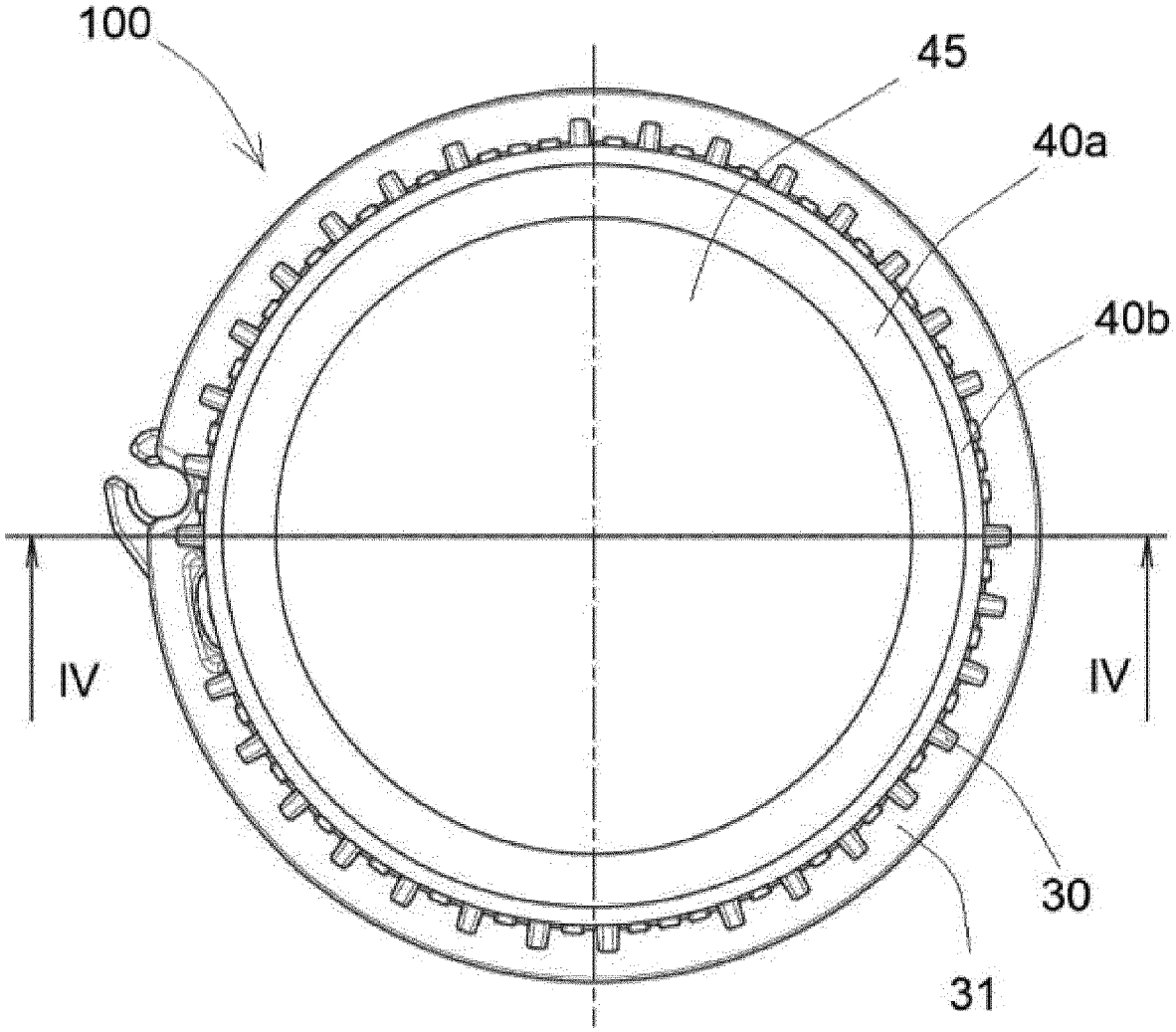
FIG. 3 is a top view of the burner of FIG. 2.
Figure 4:
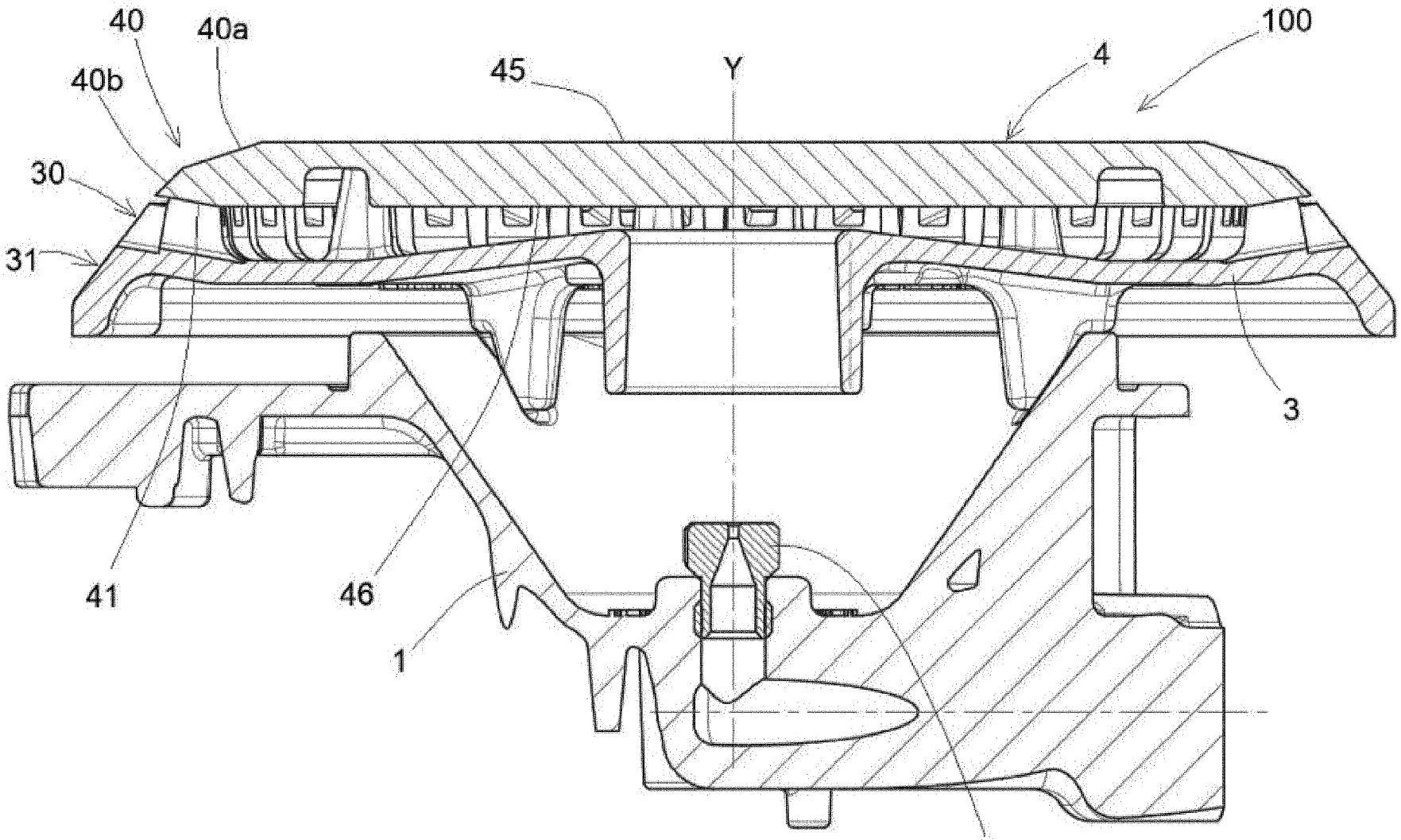
FIG. 4 is an axial view taken along the sectional plane IV-IV of FIG. 3.
Figure 4A:
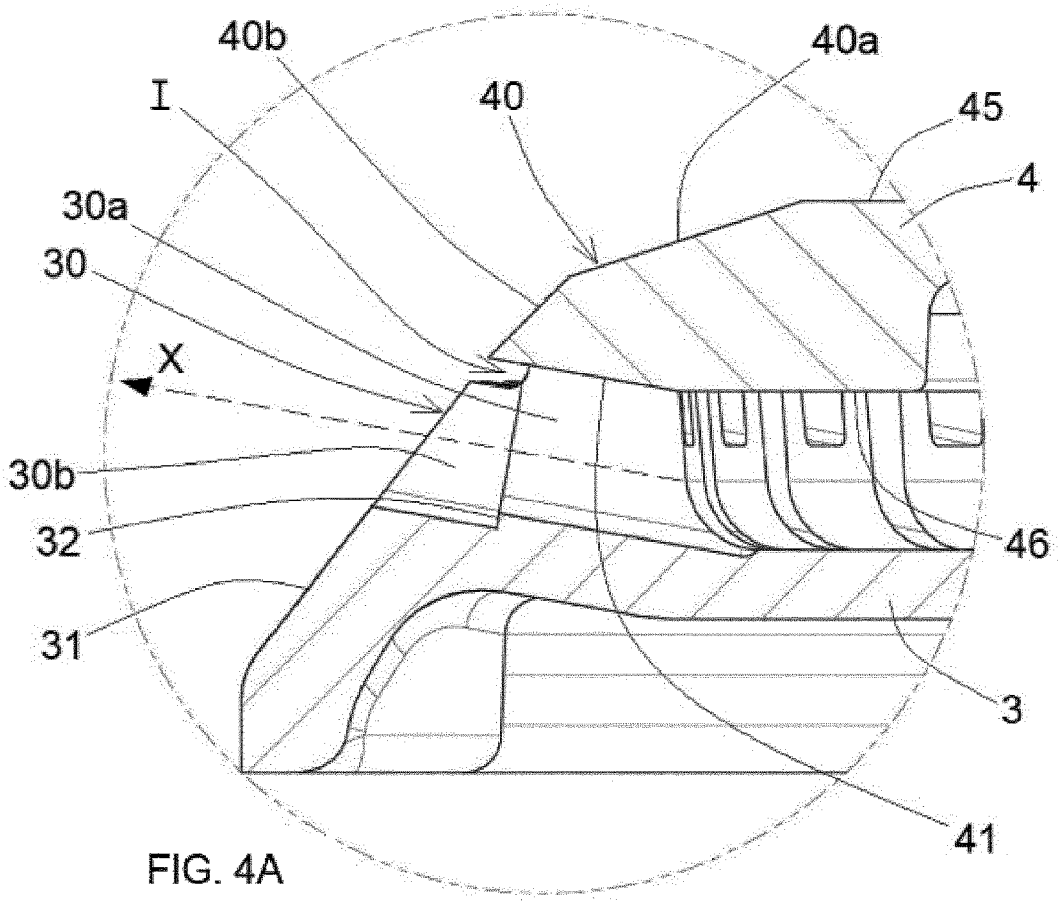
FIG. 4A is an enlarged view of a detail of FIG. 4.
Figure 4B:
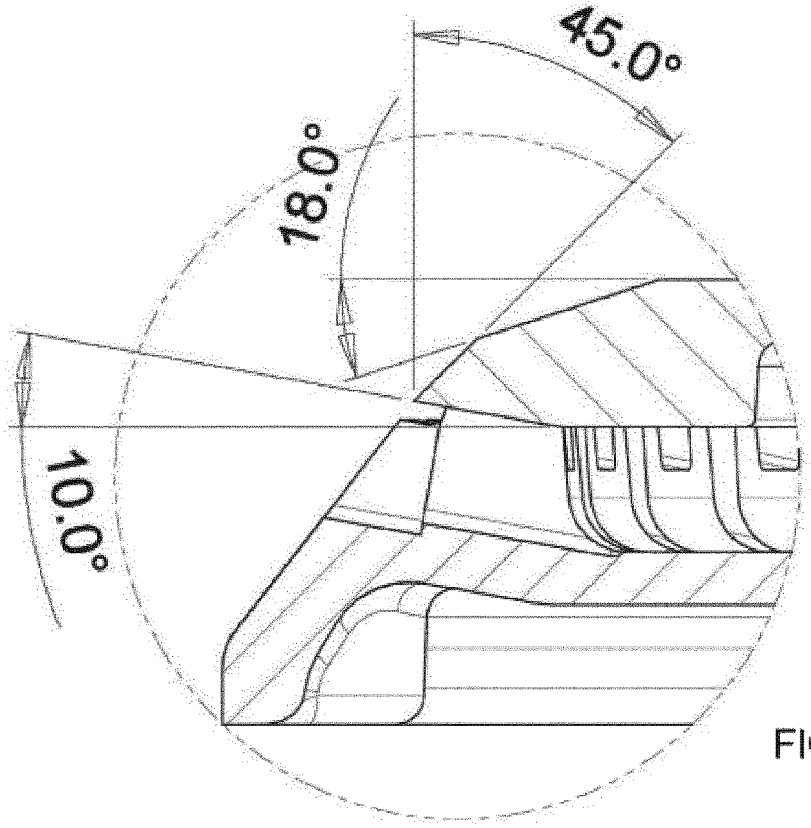
FIG. 4B is the same view as FIG. 4A, except for it shows some angles of the profile of the edge of the cap.

With reference to FIGS. 2-5, a first embodiment of a burner according to the invention is disclosed, which is generally indicated with reference numeral (100).

In the following description, elements that are identical or correspond to the ones described above will be indicated with the same numerals, omitting their detailed description.

The crown (3) has a truncated conical lateral edge (31) with a decreasing diameter going from the bottom upwards and an inclination comprised between 20°-70°, preferably 40-50°, more preferably 45°, relative to a horizontal plane that is orthogonal to a vertical axis (Y) of the burner.

A plurality of apertures (30) is radially obtained in the lateral edge (31) of the crown for the emission of flames.

Each aperture (30) is open towards the top and has a substantially "U"-shape in a front view. Each aperture (30) has a first channel (30*a*) and a second channel (30*b*) disposed in more peripheral position than the first channel. The second channel (30*b*) is larger than the first channel. In view of the above, a U-shaped step (32) is defined between the first channel (30*a*) and the second channel (30*b*). The first channel (30*a*) is longer than the second channel (30*b*). The first channel (30*a*) is higher than the second channel (30*b*).

The bottom walls of the first channel (30*a*) and of the second channel (30*b*) are inclined upwards by approximately 8°-25°, preferably 10°, relative to a horizontal plane, in such a way that said apertures (30) of the crown have an emission axis (X) of the flames that is inclined upwards by 8°-25°, preferably 10°, relative to a horizontal plane.

The cap (4) has an upper surface (45) with a circular planar horizontal shape and an inclined lateral edge (40). The lateral edge (40) comprises:

- a first truncated conical portion (40*a*) with downward inclination of approximately 10°-25°, preferably 15-21°, more preferably 18°, relative to a horizontal plane, and
- a second truncated conical portion (40*b*) with an inclination of approximately 30°-70°, preferably 40-50°, more preferably 45°, relative to a horizontal plane.

The lateral edge (40) of the cap has a lower surface (41) that is inclined by an angle of approximately 8-25°, preferably 10°, relative to a horizontal plane. The lower surface (41) of the lateral edge of the cap is joined with a bottom surface (46) disposed along a horizontal plane.

The lower surface (41) of the lateral edge of the cap is disposed on the apertures (30) of the crown, in such a way to cover the first channel (30*a*) and the second channel (30*b*).

The second truncated conical portion (40*b*) of the lateral edge of the cap is disposed in coplanar position with the lateral edge (31) of the crown.

The lower surface (41) of the lateral edge of the cap is disposed in parallel position relative to the bottom walls of the first channel (30*a*) and of the second channel (30*b*) and in parallel position relative to the emission axis (X) of the flames.

An empty space (I) is formed between an upper edge of the second channel (30*b*) and the lower wall (41) of the lateral edge of the cap.

Figure 5:
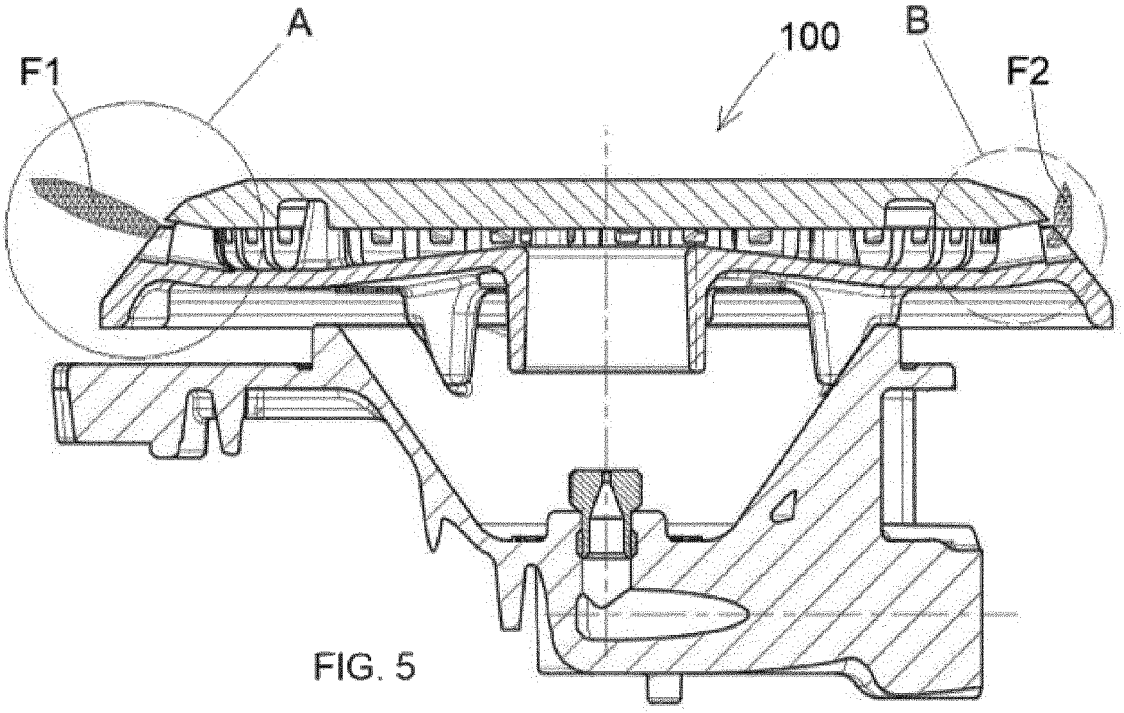
FIG. 5 is the same view as FIG. 4, and shows a flame at maximum power and a flame at minimum power in the circles A and B, respectively.
Figure 5A:
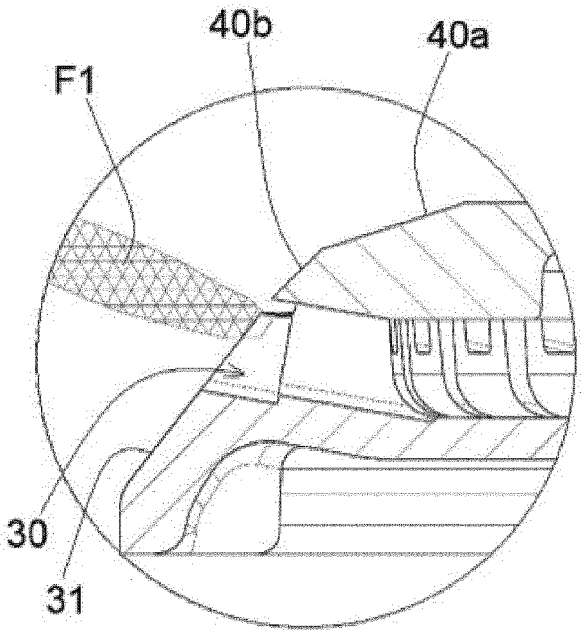
FIGS. 5A and 5B are two enlarged views of the details enclosed in the circles A and B of the burner of FIG. 5.
Figure 5B:
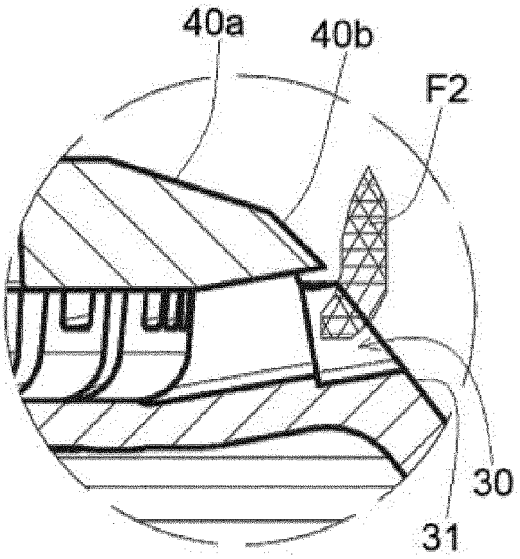

FIG. 5 shows the flames that are emitted from the apertures (30) of the crown. FIG. 5A shows a flame (F1) at maximum power and FIG. 5B shows a flame (F2) at minimum power.

The flame (F1) at maximum power and the flame (F2) at minimum power minimally touch the cap and do not embrace the lateral edge of the cap.

The special geometry of the apertures (30) of the crown and of the lateral edge of the cap (4) makes it possible to obtain a temperature value of the cap (4) that is lower than 500° C. during use.

The special shape of the lateral edge (40) and of the lower surface (41) of the lateral edge of the cap makes it possible to stabilize the flames and minimize the contact surface between the flames and the cap. In view of the above, the annular rib of the caps according to the prior art can be eliminated.

Figure 6:
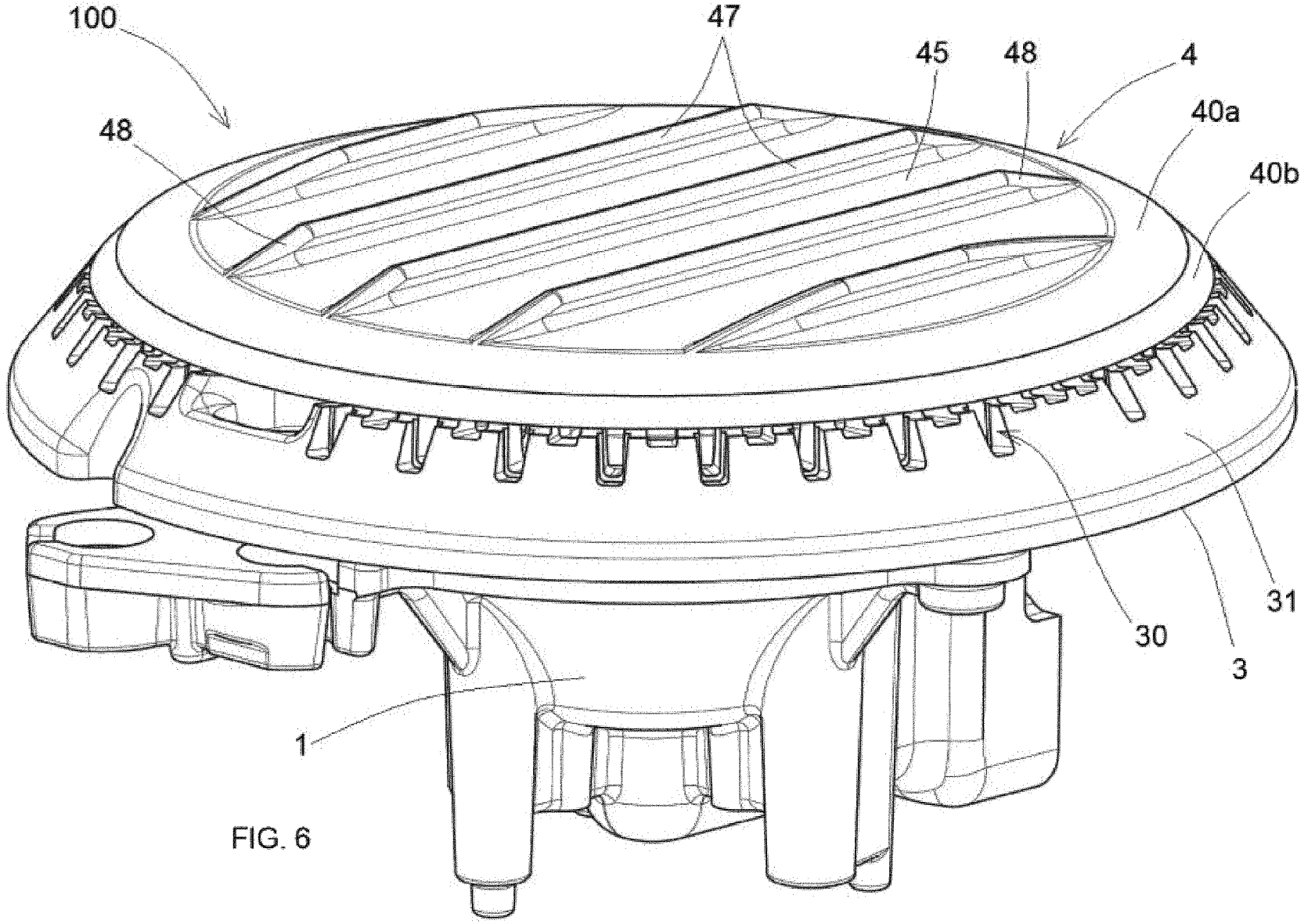
FIG. 6 is a perspective view of a variant of the cap of the burner of FIG. 4.
Figure 7:
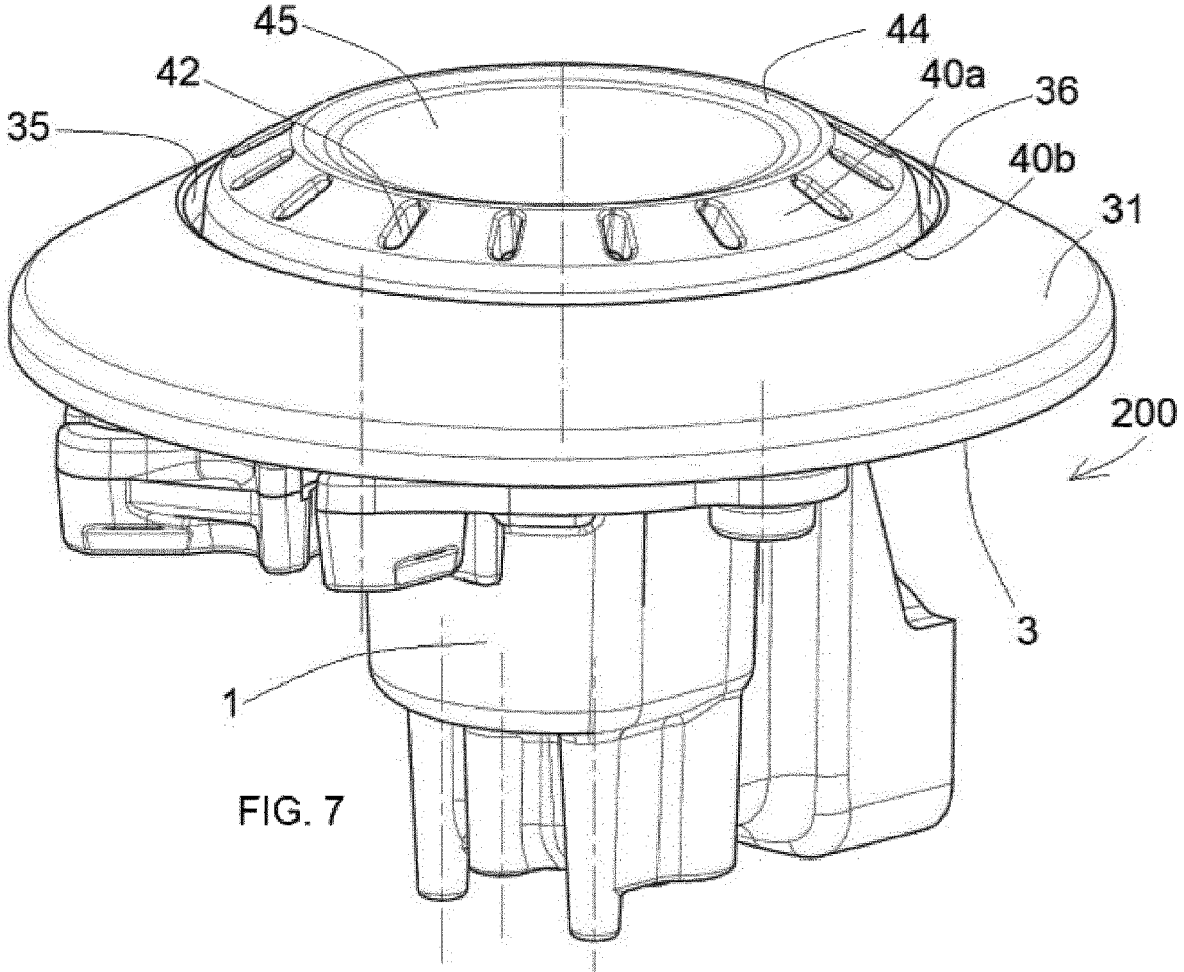
FIG. 7 is a perspective view of a second embodiment of a burner according to the invention.
Figure 8:
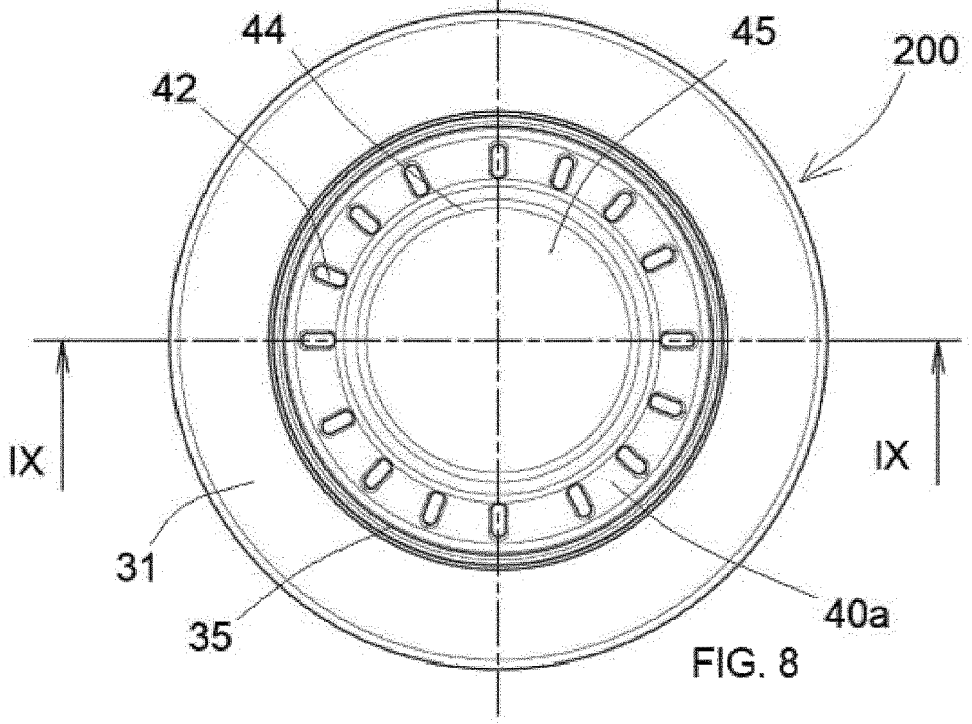
FIG. 8 is a top view of the burner of FIG. 7.
Figure 9:
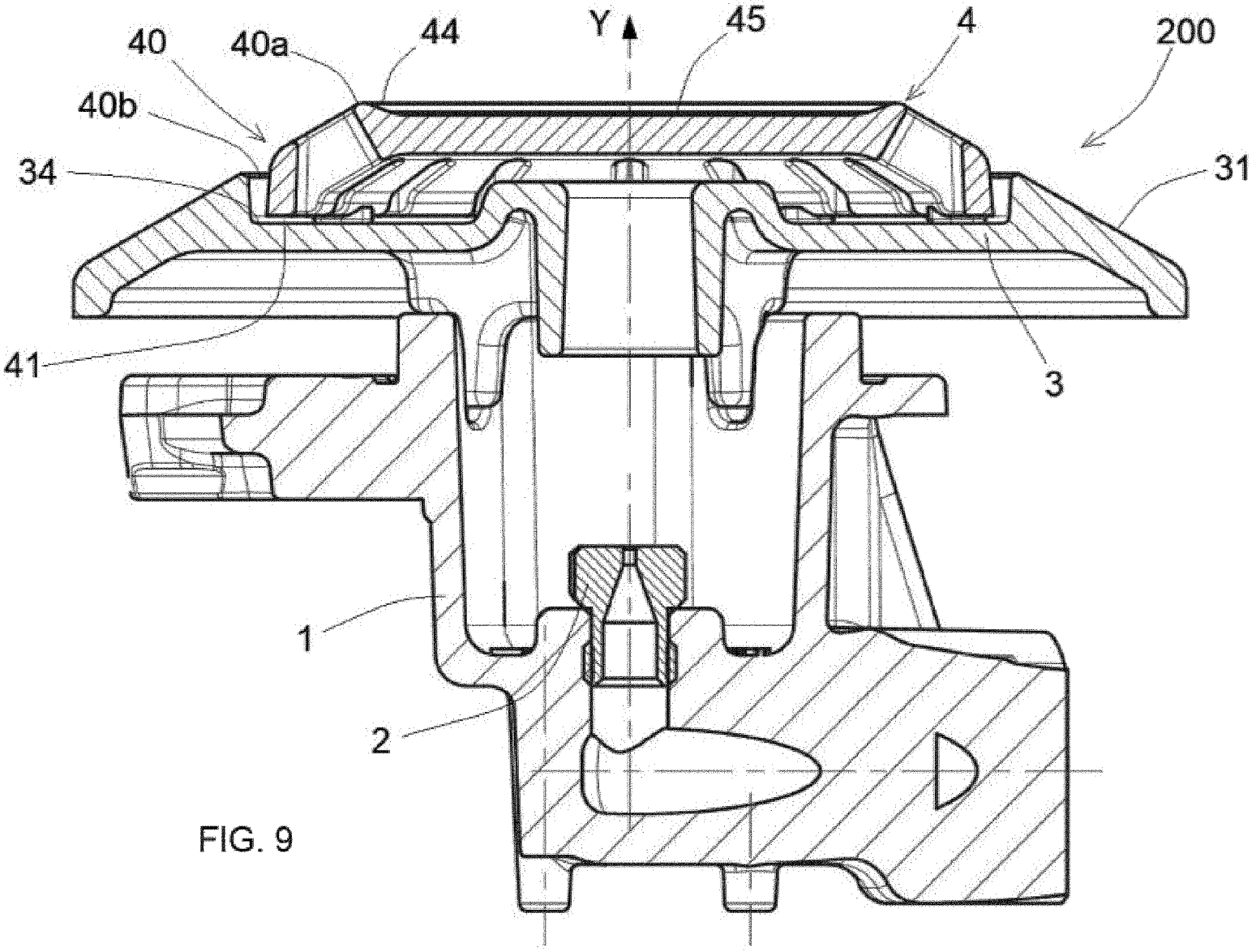
FIG. 9 is an axial view taken along the sectional plane IX-IX of FIG. 8.
Figure 9A:
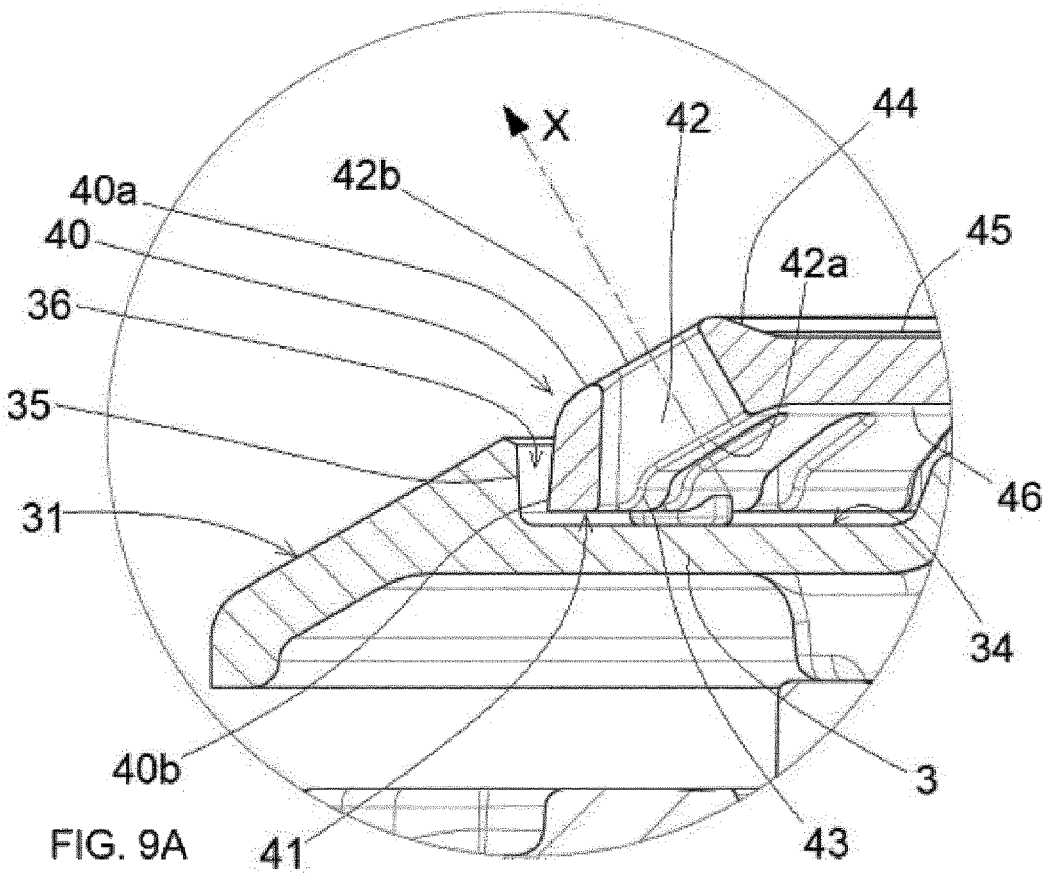
FIG. 9A is an enlarged view of detail of FIG. 9.
Figure 9B:
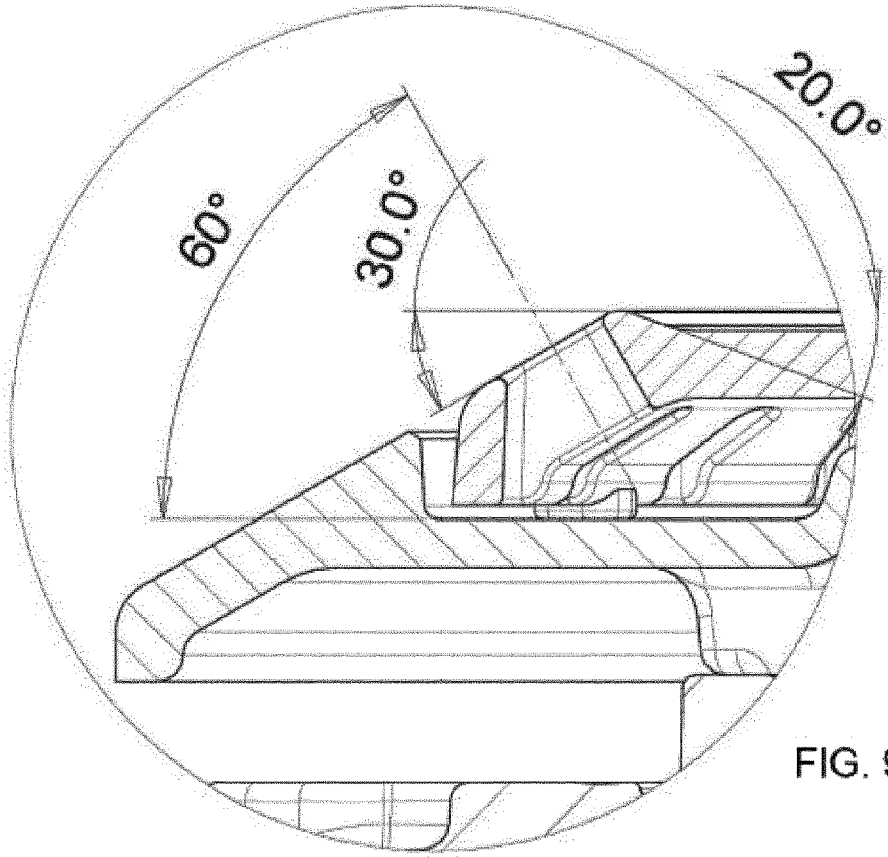
FIG. 9B is the same view as FIG. 9A, except for it shows some angles of the profile of the edge of the cap.

FIG. 6 shows a variant of the cap (4), wherein a plurality of parallel straight ribs (47) protrude from the top of the upper surface (45) of the cap.

Each rib (47) is provided with inclined ending portions (48).

With reference to FIGS. 7-10, a second embodiment of a burner according to the invention is disclosed, which is generally indicated with reference numeral (200). The crown (3) has a truncated conical lateral edge (31) with increasing diameter going from the bottom upwards and inclination comprised between 20°-70°, preferably 25-35°, more preferably 30°, relative to a horizontal plane.

The crown (3) has a cylindrical seat (34) that is open on top, wherein the cap (4) is disposed. The cylindrical seat (34) has a cylindrical lateral wall (35).

The cap (4) has an upper surface (45) with a circular planar horizontal shape. The upper surface (45) is recessed relative to a joining surface (44) that joins the upper surface (45) with a lateral edge (40).

The joining surface (44) is inclined upwards relative to the upper surface (45) by an angle comprised between 18°-22°, preferably 20°, relative to a horizontal plane.

The lateral edge (40) comprises:

- a first truncated conical portion (40*a*) with downward inclination of 20°-70°, preferably 25-35°, more preferably 30°, relative to a horizontal plane, and
- a second cylindrical portion (40*b*).

The second cylindrical portion (40*b*) of the lateral edge of the cap is disposed in distal position relative to the cylindrical lateral wall (35) of the seat of the crown, in such a way to define an annular gap (36).

The lateral edge (40) of the cap has a lower horizontal surface (41). The lower surface (41) of the lateral edge of the cap is joined with a lower joining surface (43) that is joined with a bottom surface (46) disposed along a horizontal plane.

The lower joining surface (43) is substantially parallel to the first truncated conical portion (40*a*) of the lateral edge of the cap.

A plurality of apertures (42) for the flames of the cooking hob is obtained in the first truncated conical portion (40*a*) of the lateral edge of the cap. The apertures (42) are through holes shaped like a slot, for example a rectangular slot with rounded corners. Said apertures (42) have an emission axis (X) of the flames that is orthogonal to the first truncated conical portion (40*a*) of the lateral edge of the cap. Otherwise said, the axis (X) of the apertures (42) is inclined by 20°-70°, preferably 55-65°, more preferably 60°, relative to a horizontal plane.

Each aperture (42) of the cap is shaped like a rectangular trapezium, in radial section. The inlet section (42*a*) of each aperture (42) is larger than an outlet section (42*b*).

Figure 10:
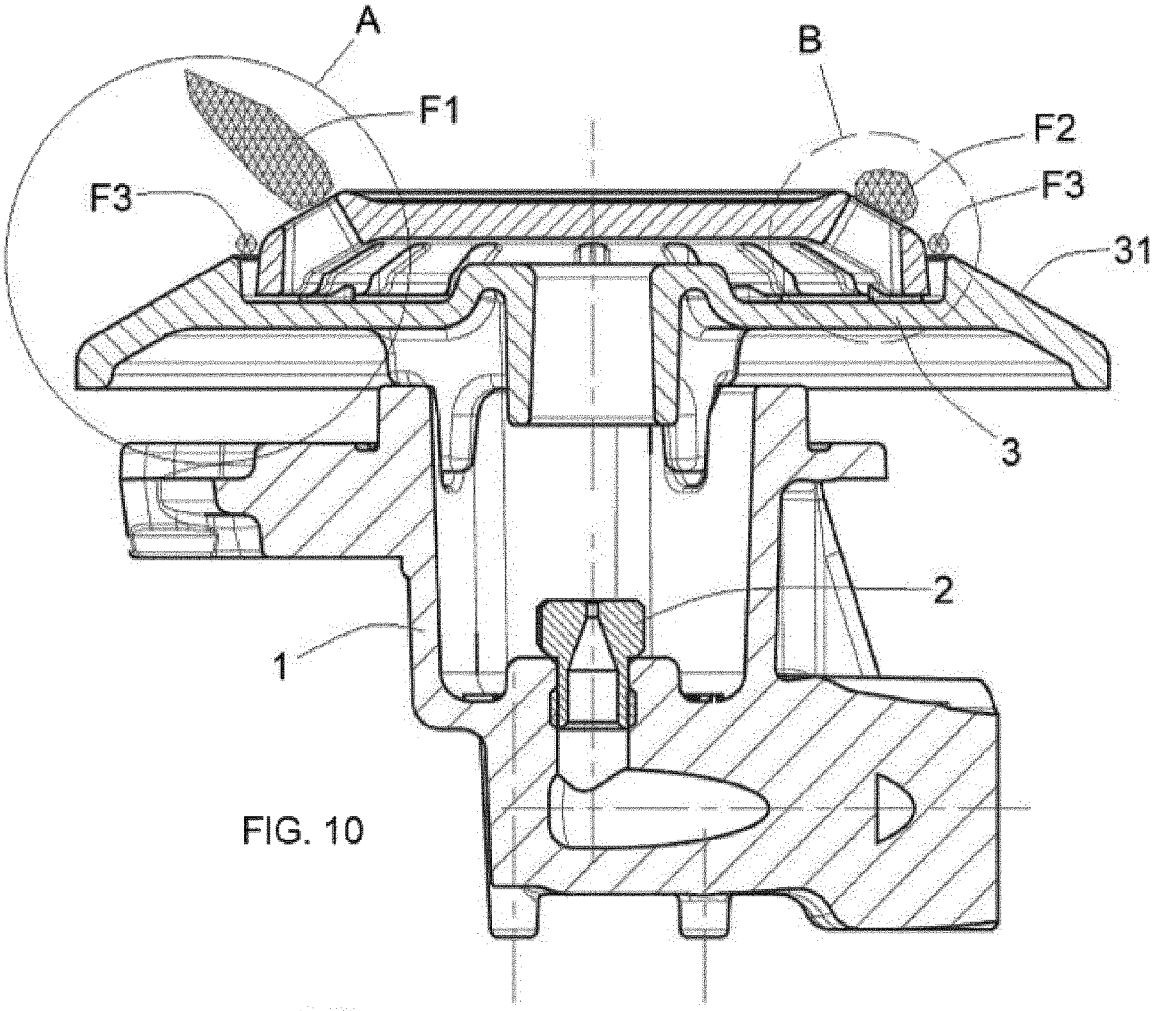
FIG. 10 is the same sectional view as FIG. 9, except for it shows a flame at maximum power and a flame at minimum power in the circles A and B, respectively.
Figure 10A:
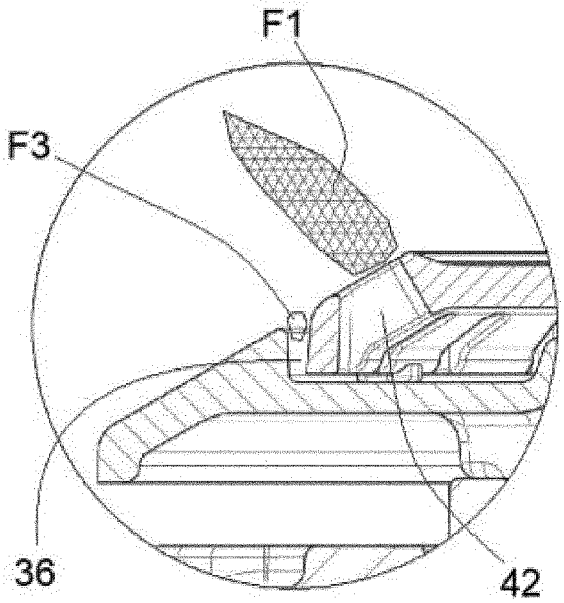
FIGS. 10A and 10B are two enlarged views of the details enclosed in the circles A and B of the burner of FIG. 10.
Figure 10B:
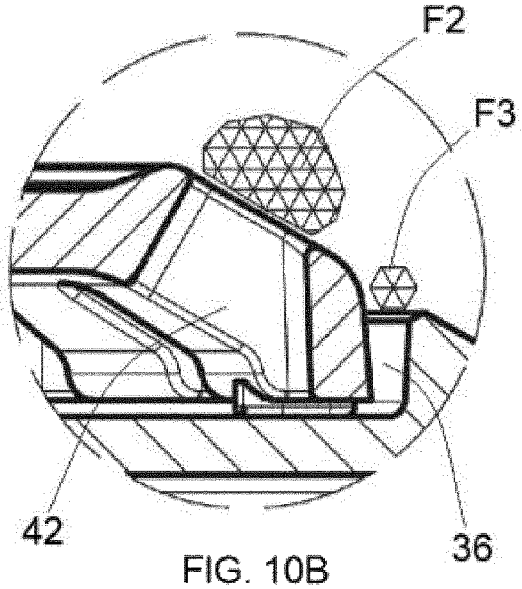
Figure 11:
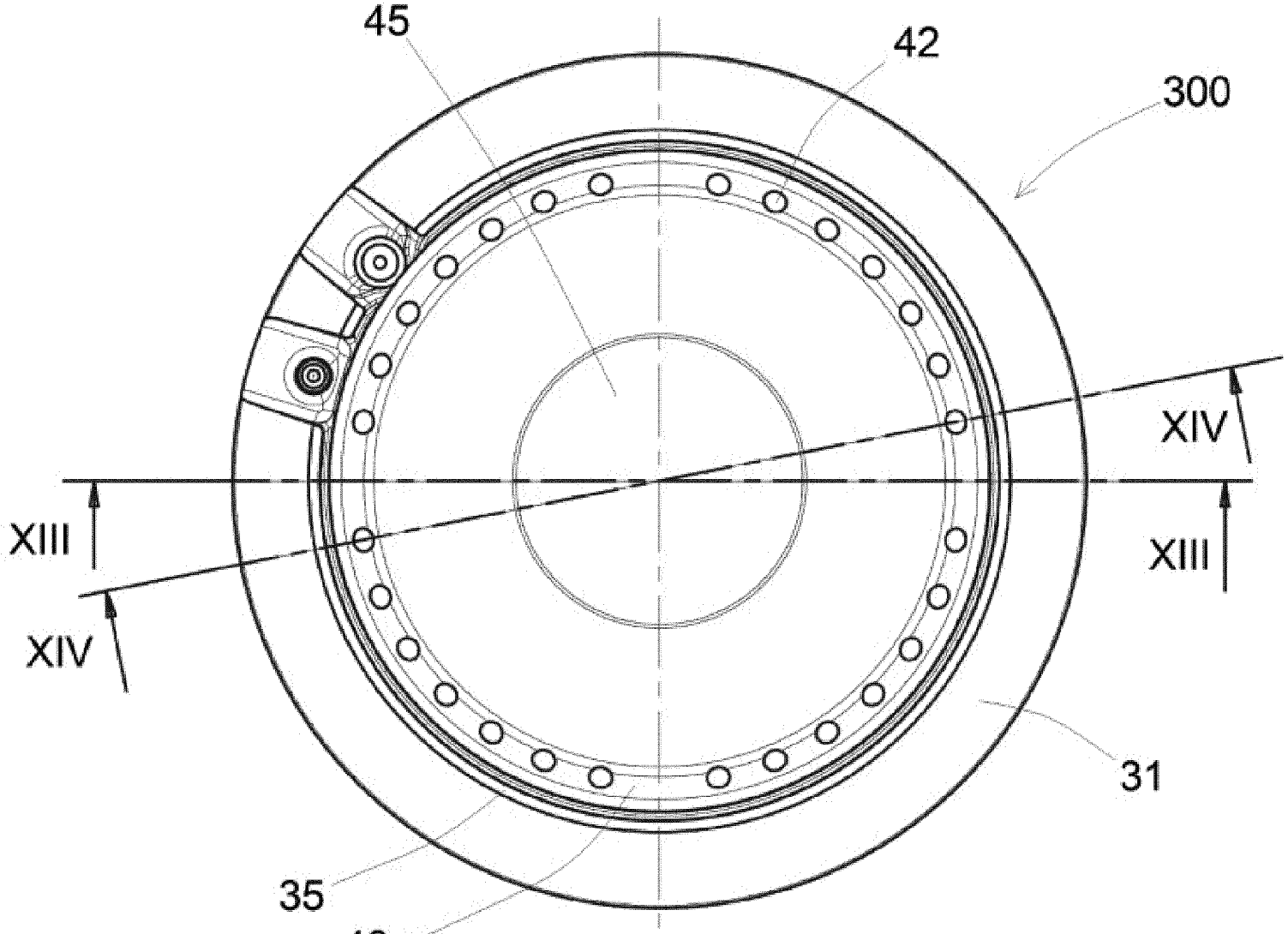
FIG. 11 is a plan view of a third embodiment of the burner according to the invention.
Figure 12:
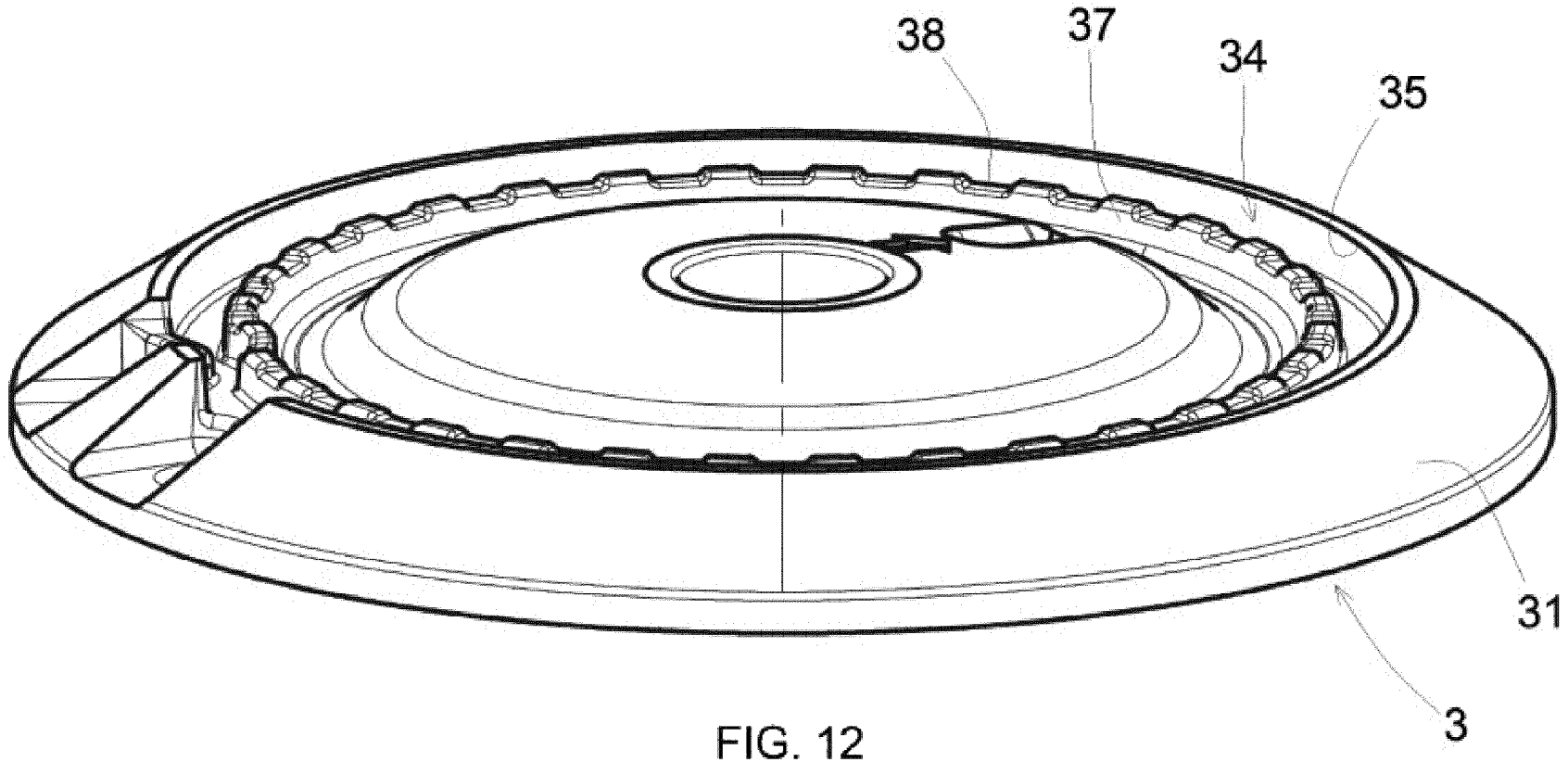
FIG. 12 is a perspective view of the crown of the burner of FIG. 11.
Figure 13:
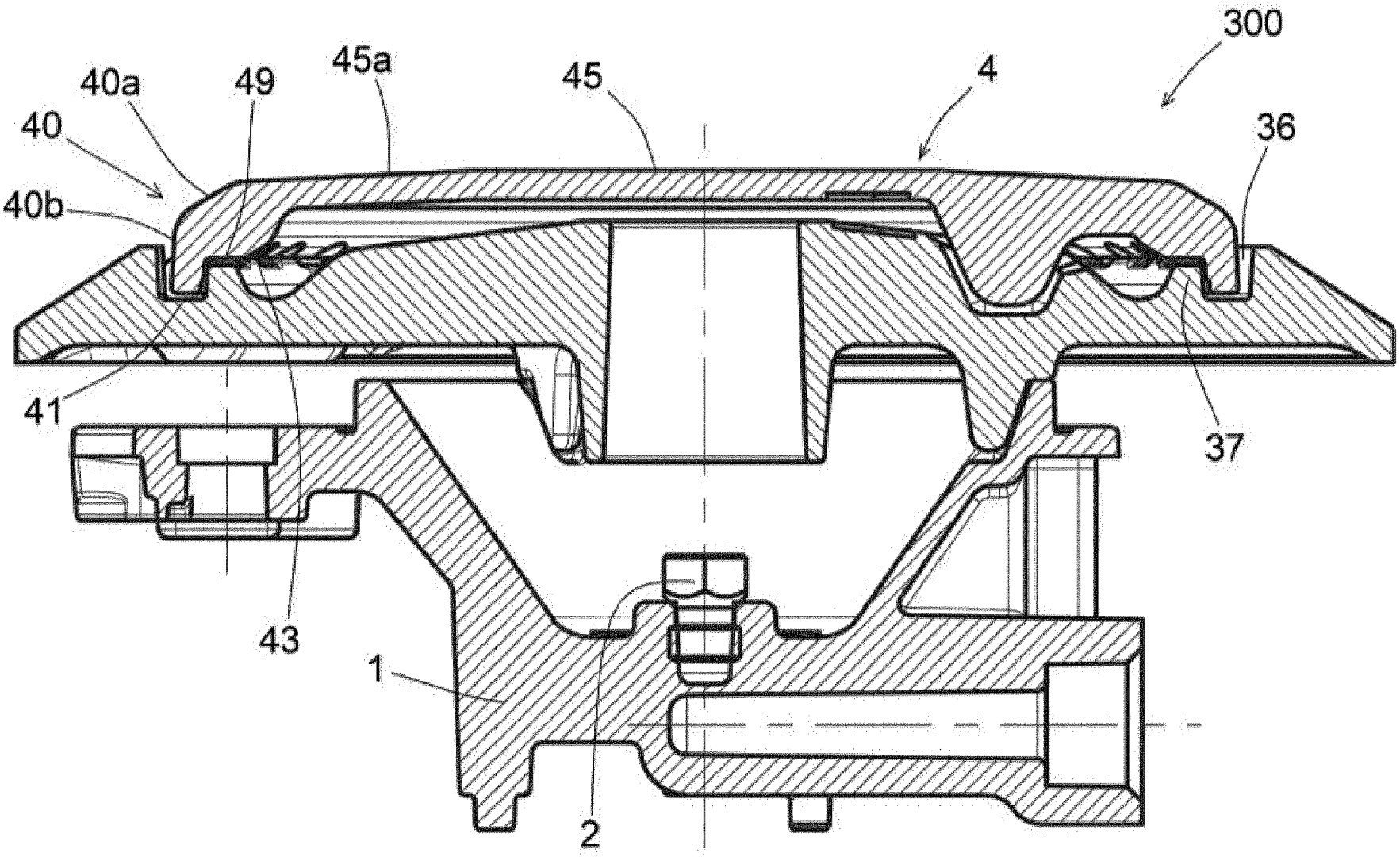
FIGS. 13 and 14 are sectional views taken along the planes XIII-XIII and XIV-XIV of FIG. 11.

FIG. 10 shows the flames that are emitted from the apertures (42) of the cap. FIG. 10A shows a flame (F1) at maximum power and FIG. 10B shows a flame (F2) at minimum power.

A pilot flame (F3) is emitted from the annular gap (36) between the second cylindrical portion (40*b*) of the lateral edge of the cap and the cylindrical lateral wall (36) of the seat of the crown.

The pilot flame (F3) is disposed under the primary flames.

Also in this case, the pilot flame (F3), the flame (F1) at maximum power and the flame (F2) at minimum power minimally touch the cap and do not embrace the lateral edge of the cap.

The special geometry of the crown (3), of the cap (4) and of the apertures (42) of the cap makes it possible to obtain a temperature value of the cap (4) that is lower than 500° C. during use.

In particular, the provision of the pilot flame (F3) at the output of the annular gap (36) makes it possible to stabilize the flames and minimize the contact surface between the flames and the cap. In this way, the annular rib of the cap according to the prior art can be eliminated.

With reference to FIG. 11-15, a third embodiment of a burner according to the invention is disclosed, which is generally indicated with reference numeral (300).

The crown (3) has a cylindrical seat (34) that is open on top, wherein the cap (4) is disposed so that a distribution chamber of air-gas mixture is defined between the crown and the cap. The cylindrical seat (34) has a cylindrical lateral wall (35).

An annular collar (37) that protrudes upwards is disposed in the cylindrical seat (34). The annular collar (37) has an upper edge with a plurality of cavities (38).

The cap (4) has a central upper surface (45) with a circular planar horizontal shape and a peripheral upper surface (45*a*) with truncated conical shape with increasing diameter from down upwards, with an inclination of approximately 1-15° relative to a horizontal plane.

The cap (4) has a lateral edge (40) that comprises:

a first truncated conical portion (40*a*) with a downward inclination of approximately 20°-70°, preferably 25-35°, more preferably 30°, relative to a horizontal plane, and a second cylindrical portion (40*b*).

The second cylindrical portion (40*b*) of the lateral edge of the cap is disposed in distal position relative to the cylindrical lateral wall (35) of the seat of the crown, in such a way to define an annular gap (36) for the pilot flames (F3).

The lateral edge (40) of the cap has a horizontal lower surface (41) that continues with a step (49) in contact with the collar (37) in such a way that the lower surface (41) is spaced from the crown for the passage of air-gas mixture in the annular gap (36) for the pilot flames. The step (49) is joined with a joining surface (43) that is substantially parallel to the first truncated conical portion (40*a*) of the lateral edge of the cap.

Figure 14:
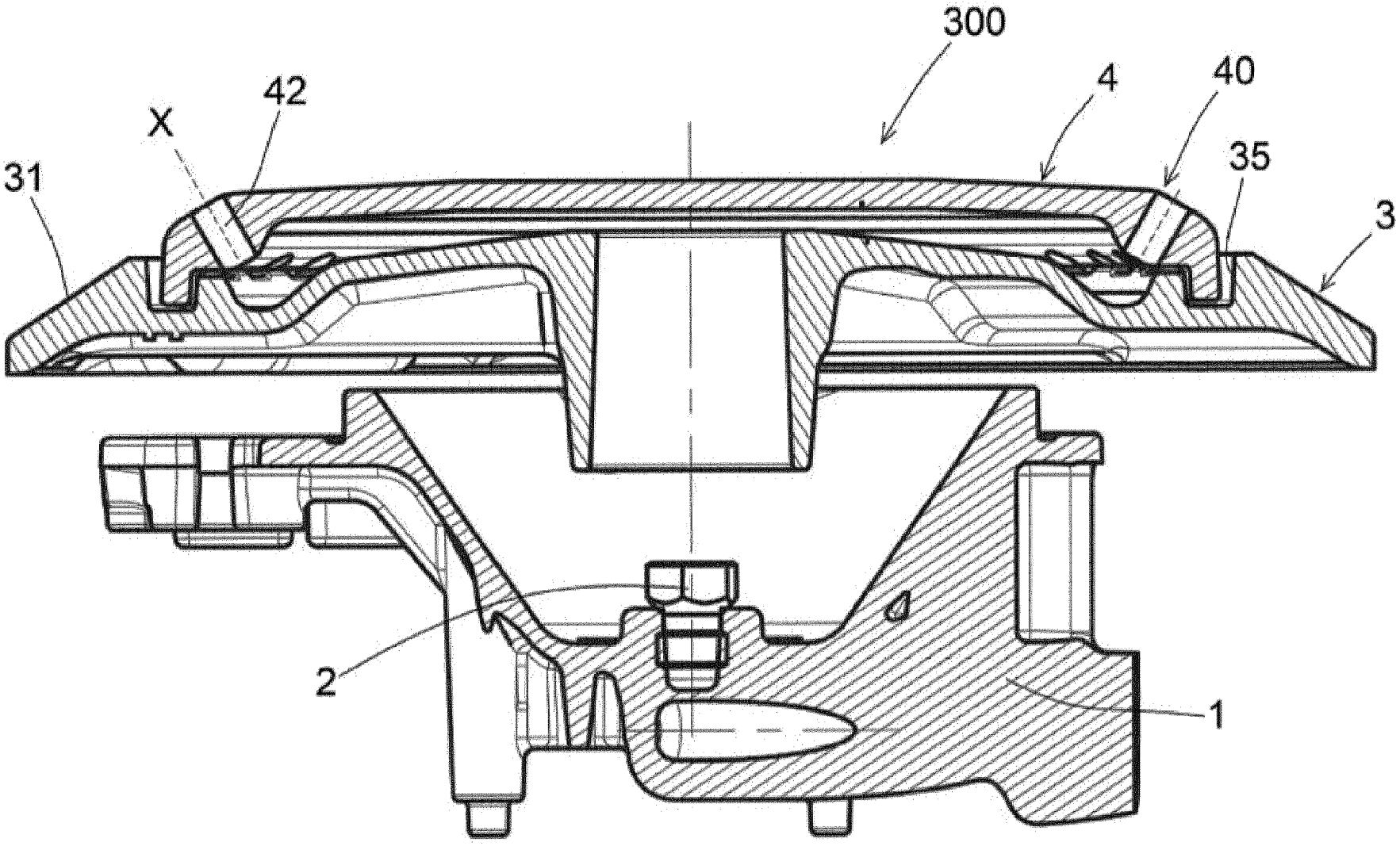
Figure 14A:
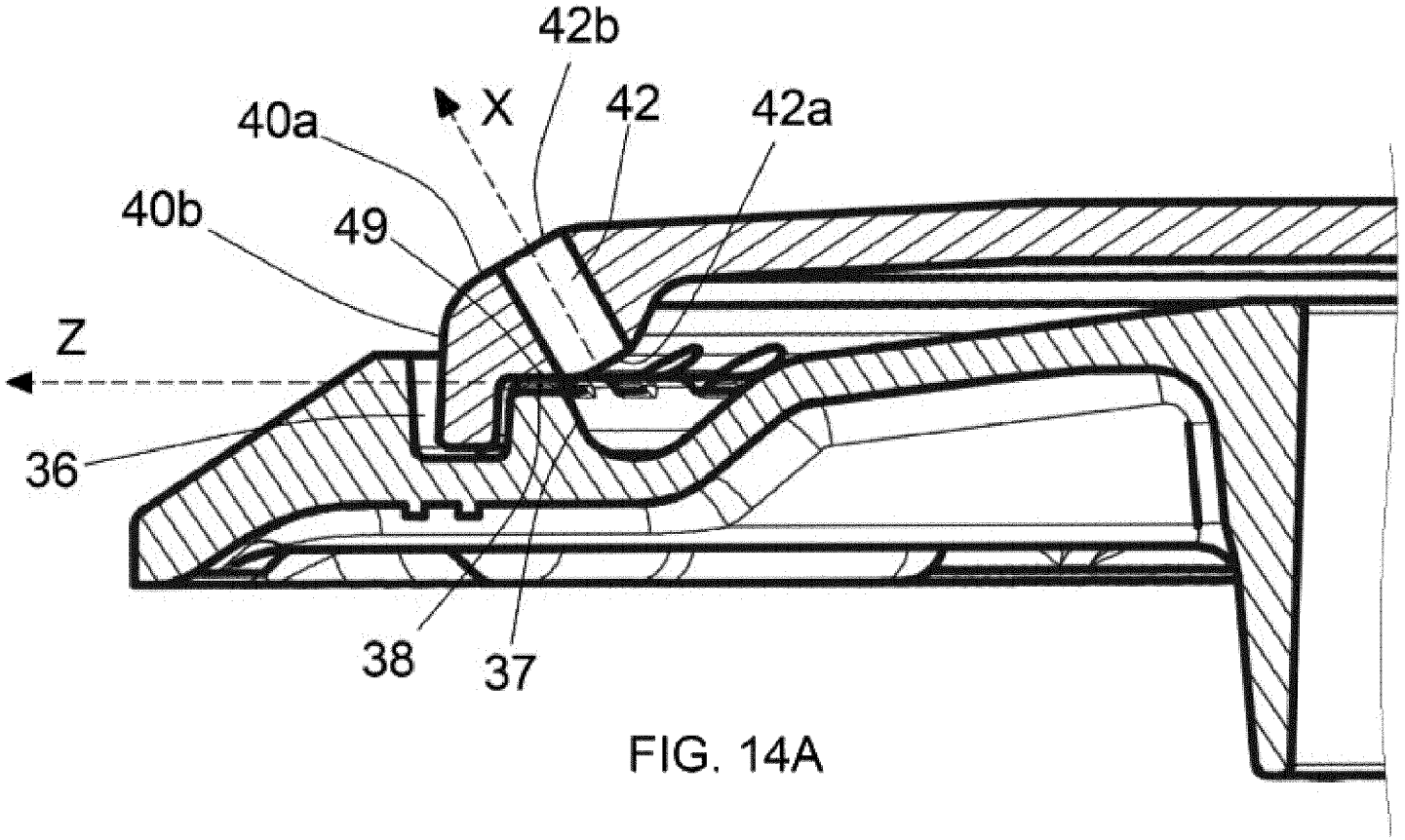
FIG. 14A is an enlarged view of a detail of FIG. 14.

With reference to FIG. 14A, a plurality of apertures (42) for the flames of the cooking hob is obtained in the first truncated conical portion (40*a*) of the lateral edge of the cap. The cap (40) is not made of low-thickness sheet metal, and is obtained by means of die-casting, and the apertures (42) are circular through holes with an axial length of approximately 5-6 mm. Said apertures (42) have an emission axis (X) of the flames that is orthogonal to the first truncated conical portion (40*a*) of the lateral edge of the cap. The axis (X) of the apertures (42) is inclined by 20°-70°, preferably 55-65°, more preferably 60°, relative to a horizontal plane. The high axial length of the apertures (42) makes it possible to keep the desired direction of the flames that are emitted from the apertures (42) of the cap, in such a way that the burner (300) can meet the requirements of a backfire test with liquid gases.

Each aperture (42) has an inlet (42*a*) and an outlet (42*b*).

It must be noted that the cavities (38) of the annular collar of the crown have a radial horizontal axis (Z). Moreover, the cavities (38) are disposed outwards in radial direction relative to the inlet (42*a*) of the apertures of the cap. Consequently, the air-gas mixture in the distribution channel flows outwards in radial direction and is divided in parts. Otherwise said, a part of the air-gas mixture flows into the apertures (42) in the direction of the axis (X) of the apertures (42) to feed the primary flames and a part of the air-gas mixture flows in the cavities (38) of the collar in the direction of the axis (Z) of the cavities to feed the annular gap (36) where the pilot flames are formed.

Such an arrangement of the cavities (38) makes it possible to feed the pilot flames correctly, stabilize the primary flames and minimize the contact surface between the flames and the cap, in such a way to obtain a die-cast cap made of a material that can withstand a temperature value lower than 500° C.

Figure 15:
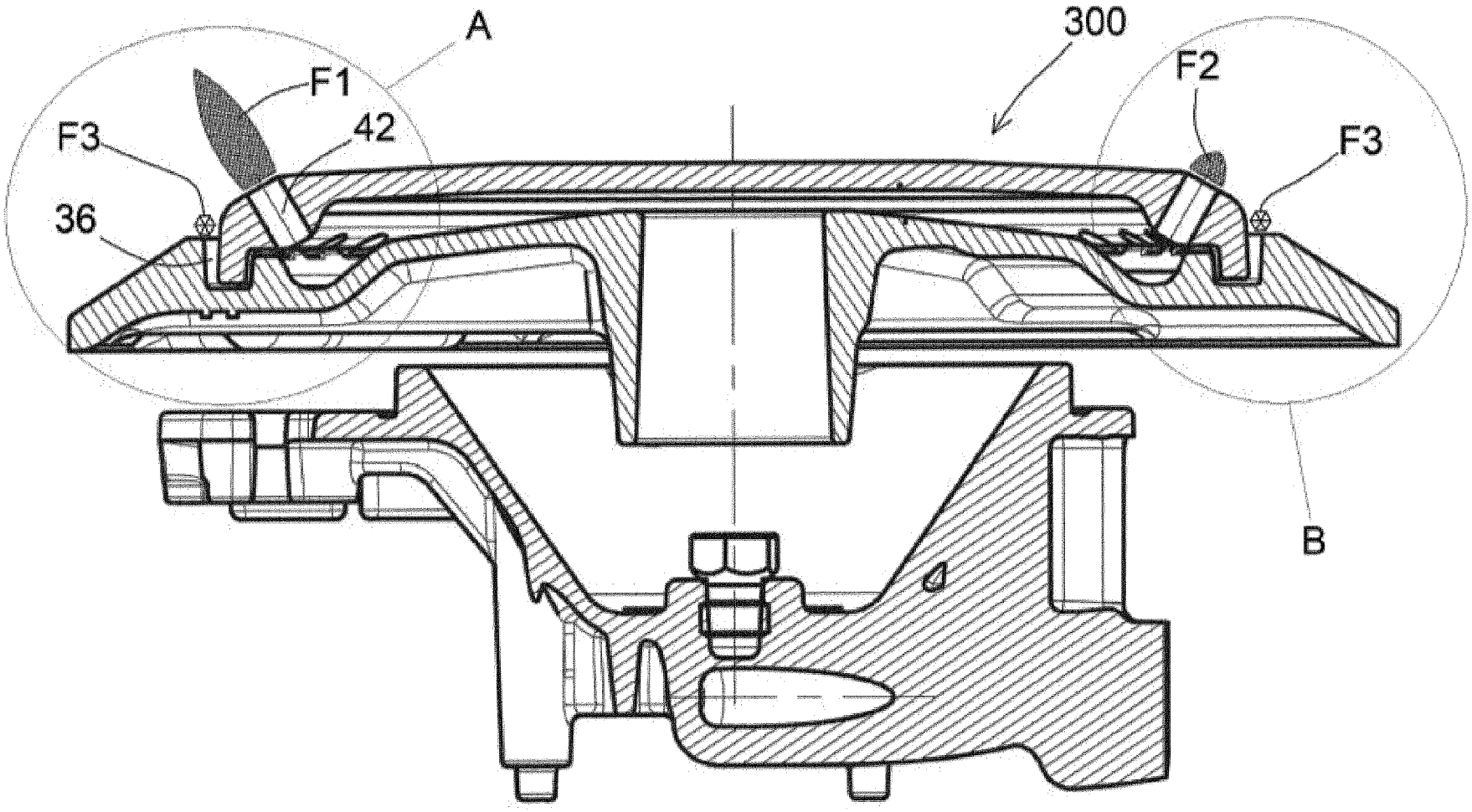
FIG. 15 is the same view as FIG. 14, and shows a flame at maximum power and a flame at minimum power in the circles A and B, respectively.

FIG. 15 shows a flame (F1) at maximum power in the circle (A) and a flame (F2) at minimum power in the circle (B).

A pilot flame (F3) is emitted from the annular gap (36) and is disposed under the primary flames.

Also in this case, the pilot flame (F3), the flame (F1) at maximum power and the flame (F2) at minimum power minimally touch the cap and do not embrace the lateral edge of the cap.

The caps (4) of the burners (100; 200; 300) according to the invention can be made with materials other than brass and steel, such as for example materials that can withstand a temperature value lower than or equal to 500° C. For example, the caps (4) can be made of die-cast aluminum.

The invention claimed is:

1. A burner comprising:

a body containing at least one injector;

a crown disposed on said body; and a cap disposed on said crown, wherein said crown comprises:

a truncated conical lateral edge with a decreasing diameter extending upwardly and an inclination of between 20° and 70° relative to a horizontal plane;

a plurality of apertures each having a U-shape in a frontal view, said plurality of apertures extending radially in said truncated conical lateral edge of said crown, said plurality of apertures adapted to allow flames to be emitted therethrough, said cap having a lateral edge that comprises;

a first truncated conical portion with a downward inclination of approximately 10° to 25° relative to the horizontal plane;

a second truncated conical portion with a downward inclination of approximately 30° to 70° relative to the horizontal plane; and a lower surface inclined by an angle of approximately 8° to 25° relative to the horizontal plane, said lower surface being disposed on said apertures of said crown.

2. The burner of claim 1, wherein each aperture of said plurality of apertures comprises a first channel and a second channel, the second channel being disposed in a more peripheral position than a position of the first channel, said second channel having a size larger than a size of the first channel.

3. The burner of claim 1, wherein said second truncated conical portion of said cap is disposed coplanar with said truncated conical lateral edge of said crown.

4. The burner of claim 2, wherein the first channel has a position higher than a position of the second channel.

5. The burner of claim 2, wherein a U-shaped step is defined between the first channel and the second channel.

6. The burner of claim 2, wherein the first channel has bottom walls and the second channel has bottom walls, wherein the bottom walls of the each of the first channel and the second channel are inclined upwards by approximately 8' to 25' relative to the horizontal plane such that the plurality of apertures of said crown have an emission axis of the flames with an upward, inclination of 8° to 25° relative to the horizontal plane.

7. The burner of claim 1, wherein said cap comprises a plurality of ribs that protrude from an upper planar surface of said cap.

8. The burner of claim 1, wherein said cap is made of an aluminum material.

9. A burner comprising:

a body containing at least one injector;

a crown disposed on said body; and a cap disposed on said crown, wherein said crown comprises:

a truncated conical lateral edge having a decreasing diameter extending, upwardly and an inclination of between 20° and 70° relative to a horizontal plane; and a cylindrical seat that is open on a top thereof, wherein said cap is disposed in a cylindrical seat, said cylindrical seat having a cylindrical lateral wall, wherein said cap has a lateral edge that comprises:

a first truncated conical portion with a downward inclination of approximately 20° to 70° relative to the horizontal plane;

a cylindrical portion;

a lower horizontal surface; and a plurality of apertures adapted to allow emission of flames from said first truncated conical portion of said cap, said plurality of apertures being through holes with an emission axis that is inclined upwards by approximately 20° to 70° relative to the horizontal plane, wherein said first cylindrical portion of said cap is disposed in a distal position relative to a position of the cylindrical lateral wall of said seat of said crown so as to define an annular gap, the annular gap adapted to allow an omission of a pilot flame, said cap having an upper surface with a circular planar horizontal shape that is recessed relative to a joining surface that joins the upper surface with the lateral edge, wherein the joining surface is inclined upwards relative to the upper surface by an mole of between 18° to 22° relative to the horizontal plane.

10. The burner of claim 9, wherein the said truncated conical portion of said cap is disposed in coplanar relation to the truncated conical lateral edge of said crown.

11. The burner of claim 9, wherein each aperture of said plurality of apertures of said cap has a rectangular trapezium shape in radial section thereof.

12. The burner of claim 9, wherein said cap is made of an aluminum material.

13. A burner comprising:

a body containing at least one injector;

a crown disposed on said body, and a cap disposed on said crown, wherein said crown comprises:

a truncated conical lateral edge with decreasing diameter extending upwardly and an inclination of between 20° to 70° relative to a horizontal plane; and a cylindrical seat that has an open top, wherein said cap is disposed so as to define a distribution chamber for an air-gas mixture between said crown and said cap, the cylindrical seat having a cylindrical lateral wall, wherein said cap has a lateral edge that comprises:

a first truncated conical portion with downward inclination of 20° to 70° relative to the horizontal plane;

a second cylindrical portion;

a lower horizontal surface with a step; and a plurality of apertures adapted to allow emission of flames from said first truncated conical portion of said cap, said plurality of apertures being through holes with an emission axis that is inclined upwards by approximately 20° to 70° relative to the horizontal plane, wherein the first cylindrical portion of said cap is disposed in a distal position relative to a position of the cylindrical lateral wall of said seat of said crown so as to define an annular gap adapted to emit a pilot flame, said crown comprising an annular collar that protrudes upwards and supports the step of the cap, the annular collar having an upper edge with a plurality of cavities, wherein said cap is die-cast and the apertures of said cap have an axial length of approximately 5 to 6 millimeters, the plurality of cavities of the annular collar of said crown each having a radial horizontal axis and arranged radially outwards with respect to an inlet of said plurality of apertures so as to be adapted to feed an air-gas mixture into the annular gap.

14. The burner of claim 13, wherein said cap is made of an aluminum material.

* * * * *